US009120619B2

(12) United States Patent
Hoopes et al.

(10) Patent No.: US 9,120,619 B2
(45) Date of Patent: Sep. 1, 2015

(54) MODULAR ABOVE-GROUND TANK

(71) Applicant: MAG Tank Hunter, LLC, Grapevine, TX (US)

(72) Inventors: Jonathan D. Hoopes, Flower Mound, TX (US); Robert W. Sloan, III, Sunnyvale, CA (US); Bradley C. Patterson, Austin, TX (US)

(73) Assignee: Mag Tank Hunter, LLC, Grapevine, TX (US)

( * ) Notice: Subject to any disclaimer, the term of this patent is extended or adjusted under 35 U.S.C. 154(b) by 0 days.

(21) Appl. No.: 14/106,433

(22) Filed: Dec. 13, 2013

(65) Prior Publication Data

US 2014/0166649 A1 Jun. 19, 2014

Related U.S. Application Data

(60) Provisional application No. 61/737,604, filed on Dec. 14, 2012.

(51) Int. Cl.

| | |
|---|---|
| ***B65D 90/02*** | (2006.01) |
| ***E02D 19/04*** | (2006.01) |
| ***B65D 90/20*** | (2006.01) |

(52) U.S. Cl.

CPC ..... *B65D 90/205* (2013.01); *E02D 19/04* (2013.01)

(58) Field of Classification Search

CPC ..... E02D 19/00; E02D 19/02; E02D 19/04; B65D 15/22; B65D 37/00; B65D 61/00; B65D 25/00; B65D 7/12; B65D 7/14; B65D 7/24; B65D 77/06

USPC ..... 220/9.1–9.4, 62.21, 562, 565; 405/11

See application file for complete search history.

(56) References Cited

U.S. PATENT DOCUMENTS

| | | | | |
|---|---|---|---|---|
| 284,185 | A | 11/1880 | Hendrick | |
| 1,284,445 | A | 11/1918 | Post | |
| 2,846,694 | A | 8/1958 | Wallace | |
| 3,974,600 | A | 8/1976 | Pearce | |
| 4,252,460 | A | 2/1981 | Johansen et al. | |
| 4,473,978 | A * | 10/1984 | Wood | 52/169.8 |
| 6,079,904 | A * | 6/2000 | Trisl | 405/107 |
| 2012/0261414 | A1 * | 10/2012 | Mann et al. | 220/62.21 |
| 2013/0087558 | A1 * | 4/2013 | Bohley et al. | 220/4.12 |

OTHER PUBLICATIONS

International Search Report and Written Opinion dated Apr. 22, 2014.

* cited by examiner

*Primary Examiner* — Steven A. Reynolds
*Assistant Examiner* — Javier A Pagan
(74) *Attorney, Agent, or Firm* — Carter Scholer Arnett Hamada & Mockler, PLLC

(57) ABSTRACT

A modular tank comprises a plurality of panels positioned on the ground or another surface to form sides of a containment wall. Each panel comprises: i) a side wall section having a trapezoidal shape; and ii) a frame assembly connected to the side wall section and configured to support the side wall section such that a first base of the trapezoid shape is disposed proximate a base of the containment wall and a second base of the trapezoid shape is supported in an elevated position to form part of an upper perimeter of the containment wall. The modular tank also includes a liner configured to be disposed on at least one of the containment wall and the ground surface to thereby form a barrier for containing fluid in the modular tank. Depending on whether the first base of a panel is wider or narrower than the second base, panels may be aligned to form straight walls or curved walls, thereby enabling the modular tank to assume different shapes.

8 Claims, 6 Drawing Sheets

300

MODULAR ABOVE-GROUND TANK

CROSS-REFERENCE TO RELATED APPLICATION(S) AND CLAIM OF PRIORITY

The present application is related to U.S. Provisional Patent No. 61/737,604, filed Dec. 14, 2012, entitled "Modular Above-Ground Tank". Provisional Patent No. 61/737,604 is assigned to the assignee of the present application and is hereby incorporated by reference into the present application as if fully set forth herein. The present application hereby claims priority under 35 U.S.C. §119(e) to U.S. Provisional Patent No. 61/737,604.

TECHNICAL FIELD

The present disclosure is directed to a modular above-ground (MAG) tank designed to store large quantities of fluids produced or required by a variety of industries and technologies.

BACKGROUND

Many industries either produce or require large quantities of water and other liquids. This is particularly true of unconventional oil and natural gas operations that use hydraulic fracturing in combination with horizontal drilling to extract oil and natural gas. The process of hydraulic fracturing requires millions of gallons of water that are mixed with sand and other lubricating agents and injected into hydrocarbon formations under controlled high pressure to break open the rock, expand and hold open the fractures, thereby allowing oil and natural gas to flow to the well head. Following hydraulic fracturing, some of the fluids that are injected along with fluids that are naturally resident in the formation are returned to the surface. These fluids need to be managed in a responsible and cost-effective manner. Storing and disposing of these fluids in an environmentally safe manner present significant challenges. Many commercial operations use tanker trucks, rail cars or pipelines to haul waste fluids away for disposal. This greatly increases costs if the amount of waste liquid is large and the disposal facility is remote. Transporting fluids also created hazards and increases road or rail traffic.

To support industrial processes that require or produce large quantities of water or other liquids, many operators build temporary modular above-ground (MAG) fluid storage tanks to hold wastewater or other fluids. Such tanks may be deployed in, for example, an oilfield. Oilfield operators and similar industries that use MAG tanks constantly seek to improve logistics, increase safety, increase flexibility, lower costs, and expedite the set-up and take-down times of the MAG tanks.

SUMMARY

To address the above-discussed deficiencies of the prior art, it is a primary object to provide a modular tank comprising a plurality of panels positioned on a ground surface to form sides of a containment wall. Each panel comprises: i) a side wall section having a trapezoidal shape; and ii) a frame assembly connected to the side wall section and configured to support the side wall section such that a first base of the trapezoid shape is disposed proximate a base of the containment wall and a second base of the trapezoid shape is supported in an elevated position to form part of an upper perimeter of the containment wall.

In one embodiment, the side wall section comprises a grid having holes therein.

In another embodiment, the side wall section comprises a solid surface.

In still another embodiment, the modular tank further comprises a liner configured to be disposed on at least one of the containment wall and the ground surface to thereby form a barrier for containing fluid in the modular tank.

In yet another embodiment, a first one of the plurality of panels is configured such that the first base of the trapezoidal shape is wider than the second base of the trapezoidal shape.

In a further embodiment, a side wall section of the first panel is removably attached to a frame assembly of the first panel.

In a still further embodiment, a second one of the plurality of panels is configured such that the second base of the trapezoidal shape is wider than the first base of the trapezoidal shape.

In a yet further embodiment, a side wall section of the second panel is removably attached to a frame assembly of the second panel.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 6, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged modular above-ground (MAG) tank.

A modular above-ground (MAG) tank according to the principles of the present disclosure may be used in a number of industries including, but not limited to: 1) oil and gas exploration, 2) hydraulic fracturing, 3) industrial fluid treatment, 4) water recycling, and 5) municipal water treatment. The fluids that the disclosed MAG tank may store include, but are not limited to: 1) fresh water, 2) rain water, 3) salt water, 4) brine, 5) waste water, 6) storm water, 7) oil and gas drilling fluid (mud), 8) frack water, 9) industrial water, 10) reuse water, 11) recycled water, 12) oil, 13) any fluid with a weight of less than 50 lbs/gallon, and 14) secondary containment for any product.

A MAG tank system according to the principles of the present disclosure may be installed in a virtually unlimited number of configurations. The trapezoidal geometry of the component panels of the MAG tank allows each panel to be installed in two different configurations allowing for walls of the tank to be made in straight lines or curves. This unique design allows the MAG Tank to be a circle, a square, a rectangular, or virtually any polygon or free-form shape.

The disclosed MAG tank is designed on the principles of a cofferdam, which provides a transfer of weight to the perpendicular plane, thereby eliminating hoop stresses. This allows for a variety of fluids to be used in the system, including high-density fluids.

Figure 1:
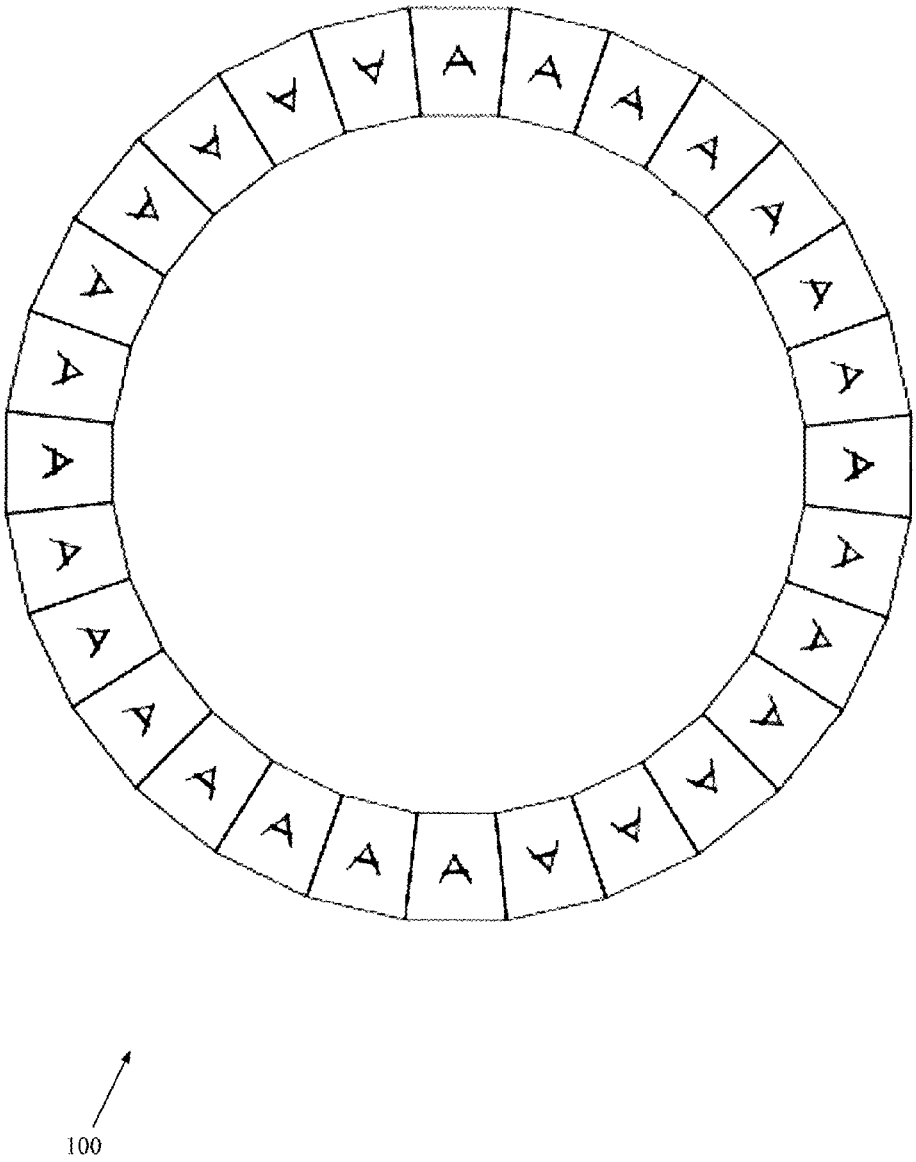
FIG. 1 is a top view of an exemplary modular above-ground (MAG) tank according to one embodiment of the disclosure.

FIG. 1 is a top view of exemplary modular above-ground (MAG) tank 100 according to one embodiment of the disclosure. In FIG. 1, the walls of MAG tank 100 comprise a plurality of panels, wherein each panel (labeled A) is substantially an isosceles trapezoid. Each panel is held in an inclined or sloped position by a brace assembly (not shown) to form a tank having specified depth. For each trapezoidal panel, the wide base of the trapezoid forms part of the outer edge or perimeter of MAG tank 100 and the narrow base of the trapezoid forms part of the inner edge or perimeter of the MAG tank 100. By positioning the panels so that sloped surfaces of adjoining panels touch or are in close proximity, a many-sided polygon is formed that approximates a circular tank. MAG tank 100 is assembled on an open and substantially level area of ground or other surface. A liner may then be placed over the assembled panels and the ground area inside MAG tank 100 in order to contain the fresh water, wastewater or other fluid in MAG tank 100.

Figure 2:
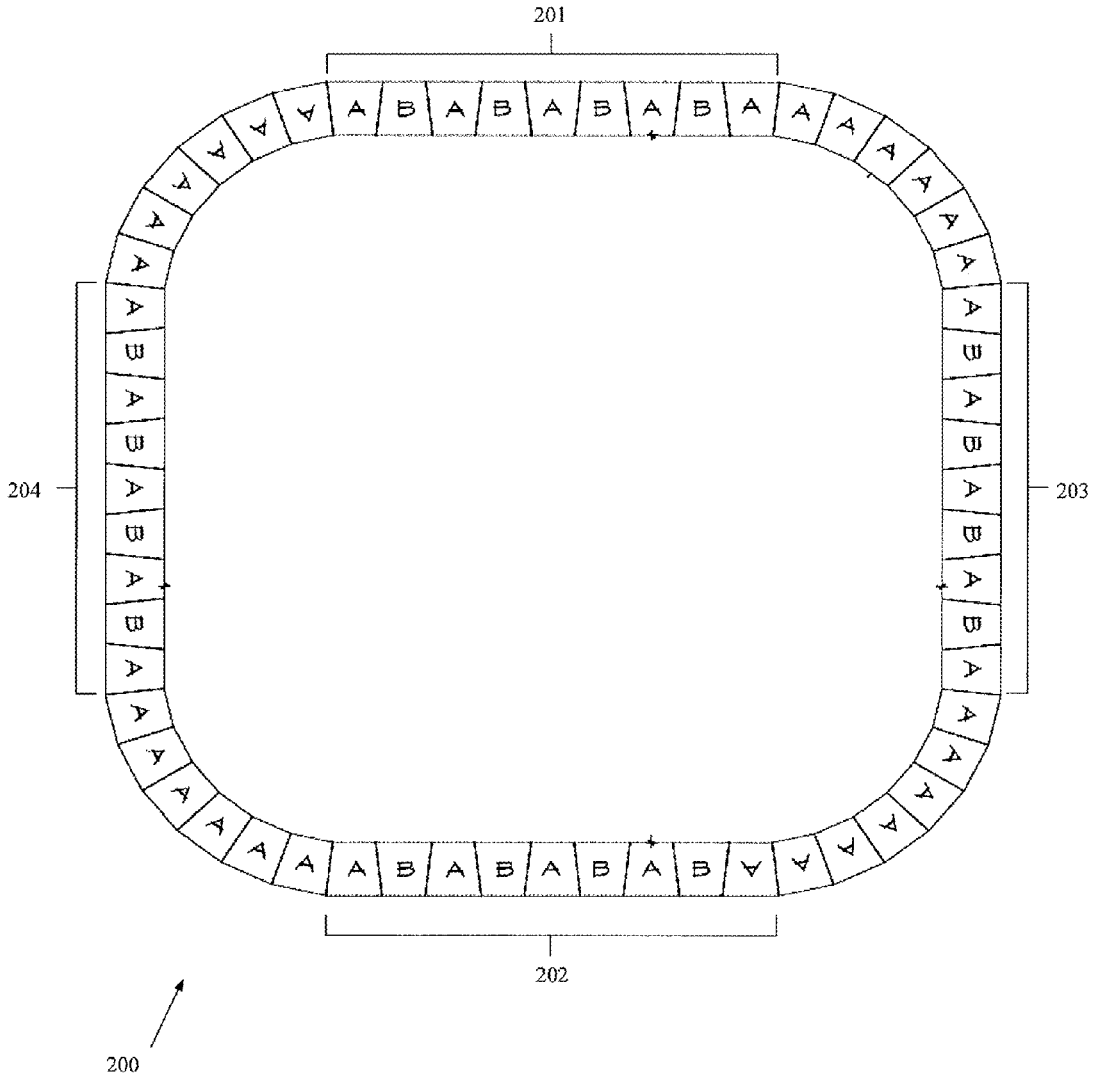
FIG. 2 is a top view of an exemplary modular above-ground (MAG) tank according to another embodiment of the disclosure.

FIG. 2 is a top view of exemplary modular above-ground (MAG) tank 200 according to another embodiment of the disclosure. In FIG. 2, the walls of MAG tank 200 comprise a plurality of panels, wherein each panel (labeled A or B) is substantially an isosceles trapezoid. For each trapezoidal panel labeled A, the wide base of the trapezoid forms part of the outer edge (or perimeter) of MAG tank 200 and the narrow base of the trapezoid forms part of the inner edge (or perimeter) of MAG tank 200. For each trapezoidal panel labeled B, the wide base of the trapezoid forms part of the inner edge (or perimeter) of MAG tank 200 and the narrow base of the trapezoid forms part of the outer edge (or perimeter) of MAG tank 200.

Straight sides 201-204 are formed by assembling alternating "A" panels and "B" panels in a row. The concave curved corners between sides 201-204 are formed by using consecutive "A" panels. However, in an alternate configuration (not shown), a convex curved corner can be formed by using consecutive "B" panels. By positioning the panels as shown in FIG. 2, a substantially rectangular tank with curved corners is formed. MAG tank 200 is assembled on an open and substantially level area of ground. A liner may be placed over the assembled panels and the ground area inside MAG tank 200 in order to contain the wastewater or other fluid in MAG tank 100.

Figure 3:
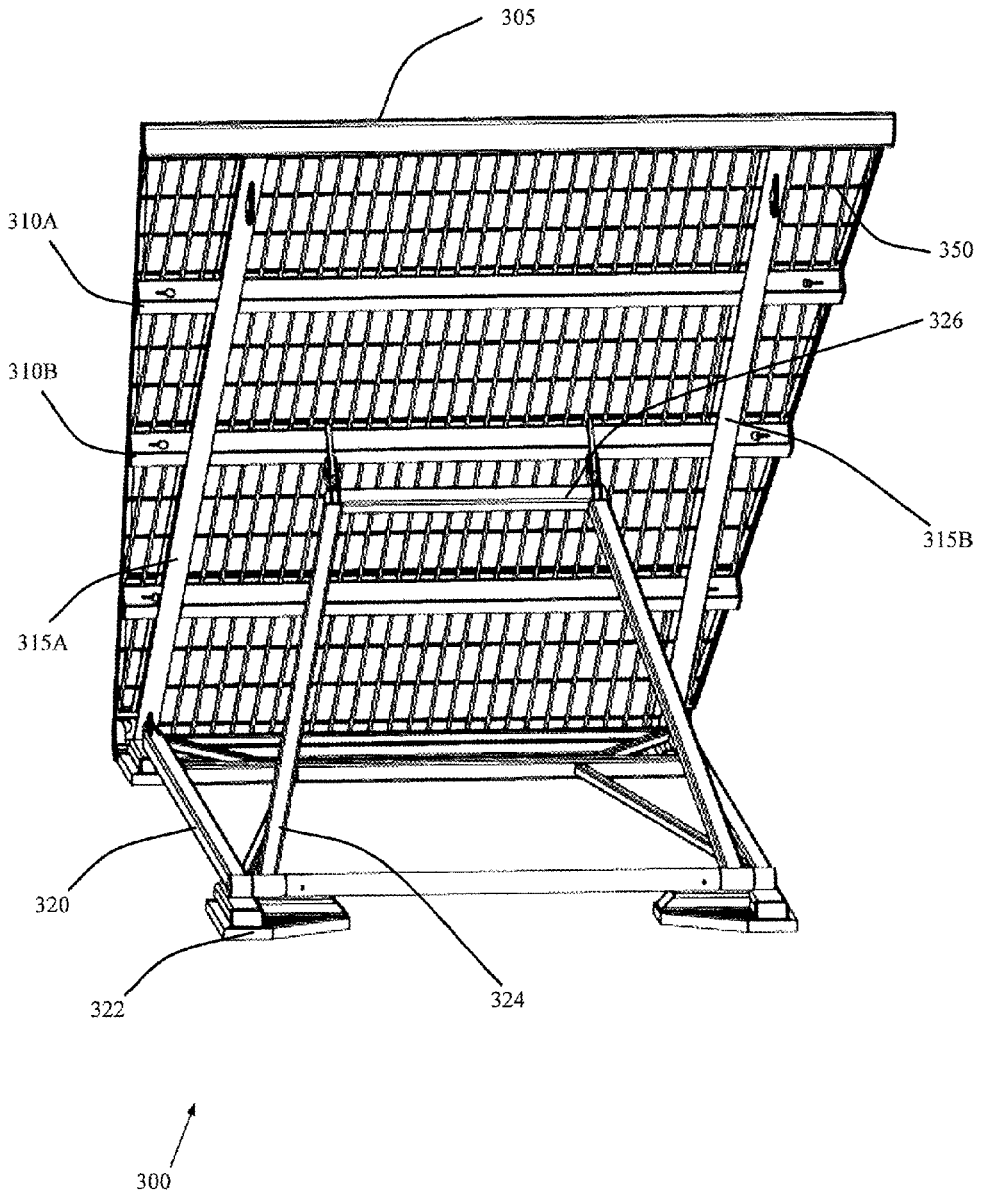
FIG. 3 is a rear perspective view of a component panel of a MAG tank according to an embodiment of the disclosure.

FIG. 3 is a rear perspective view of component panel 300 of a MAG tank according to an embodiment of the disclosure. Panel 300 comprises a frame assembly that supports a side wall section of the wall of the MAG tank in an inclined or sloped position. The frame assembly comprises I-beam frame 305, base frame 320, and brace frame 324. I-beam frame 305 comprises a plurality of horizontal I-beams (e.g., I-beams 310A, 310B) and a plurality of vertical I-beams (e.g., I-beams 315A, 315B). Panel 300 further includes base frame 320 and brace frame 324. Brace frame 324 includes horizontal brace 326. A plurality of feet 322 are attached to the bottom of base frame 320 for supporting base frame 320 on the ground.

The side wall section may comprise a grid 350 that forms a section of the side of the MAG tank. Grid 350 is attached to I-beam frame 305 to form the side section surface of component panel 300 on which a liner may be attached. In an advantageous embodiment, grid 350 may be a grill or grating having holes therein and made of steel or another metal in order to save weight. However, in an alternate embodiment, grid 350 may be replaced by a solid plate or similar surface.

Figure 4:
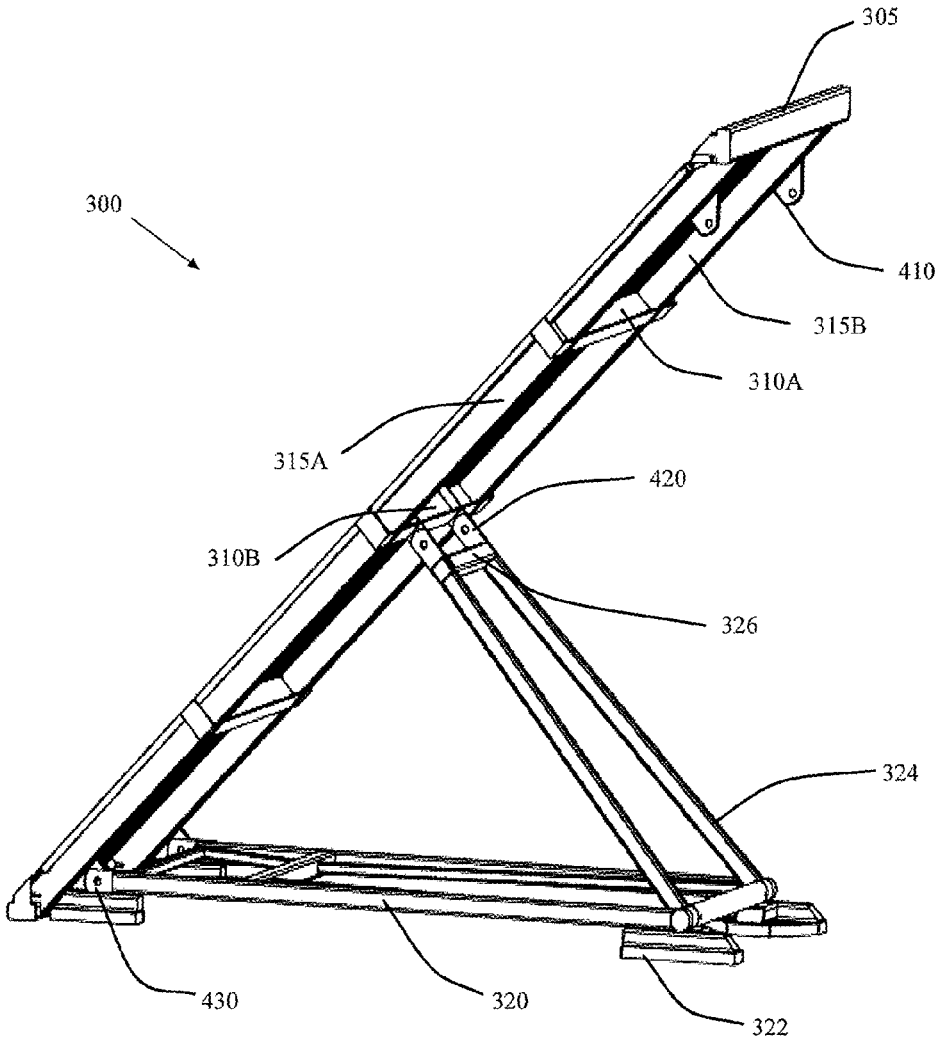
FIG. 4 is a side perspective view of a component panel of a MAG tank according to an embodiment of the disclosure.

FIG. 4 is a side perspective view of component panel 300 of a MAG tank according to an embodiment of the disclosure. FIG. 4 further show connectors 410, 420 and 430. Connectors 410, 420, and 430 allow I-beam frame 305 to be connected to base frame 320 and brace frame 324. In the configuration shown in FIG. 3, base frame 320 is removably attached to connector 430 and brace frame 324 is removably connected to connector 420, so that the narrow base of the trapezoid ("A" panel) is on the bottom. However, in an alternate configuration (not shown), grid 350 and I-beam frame 305 may be rotated 180 degrees so that base frame 320 may be removably attached to connector 410 and brace frame 324 may be removably connected to connector 420. In this alternate configuration, the wide base of the trapezoid ("B" panel) is on the bottom. In this manner, the two configurations may be used to form the "A" panels and "B" panels in FIGS. 1 and 2.

Figure 5:
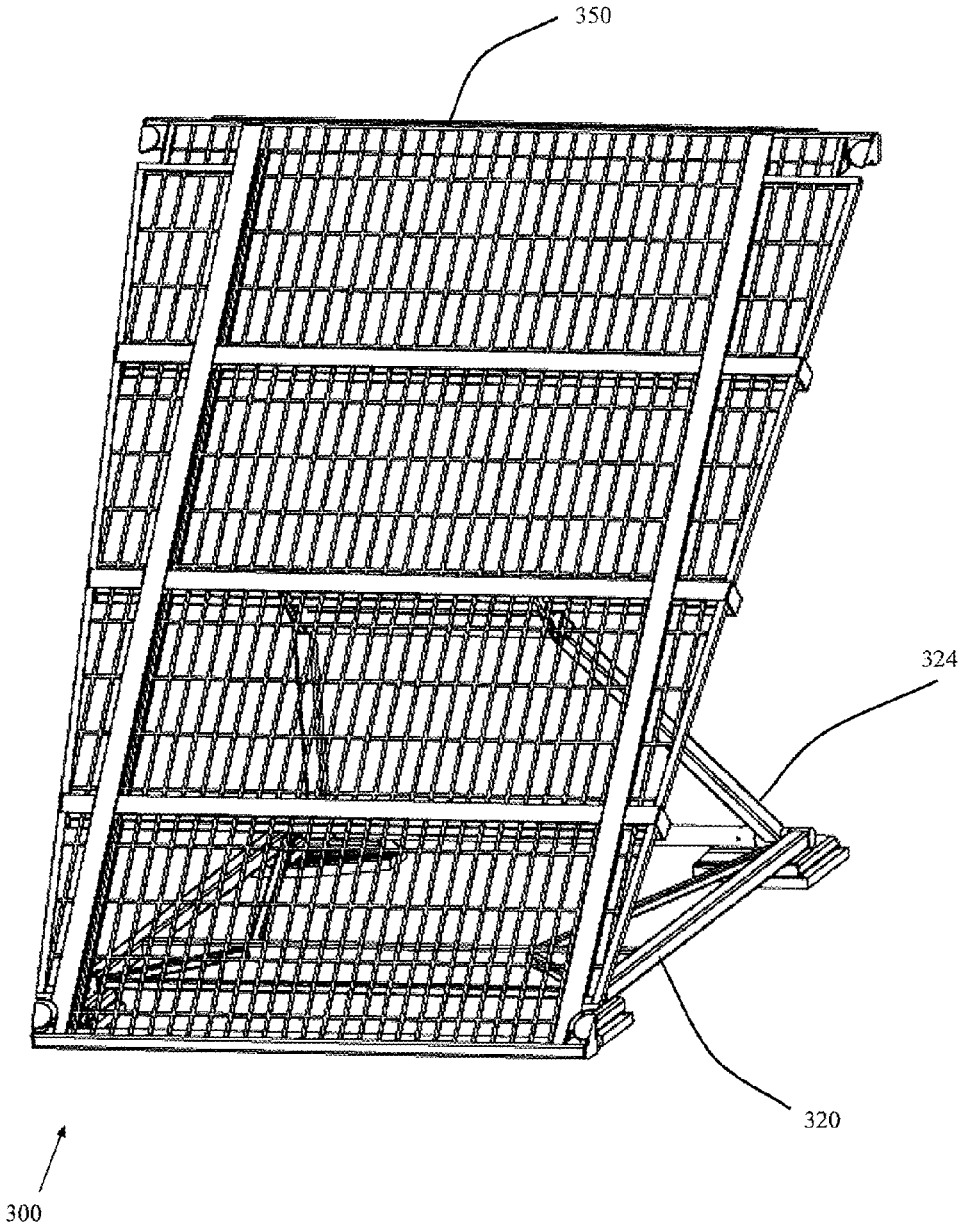
FIG. 5 is a front perspective view of a component panel of a MAG tank according to an embodiment of the disclosure.

FIG. 5 is a front perspective view of component panel 300 of a MAG tank according to an embodiment of the disclosure. Base frame 320 and brace frame 324 are partially visible to the side of grid 350. Grid 350 comprises a support surface for a liner that contains liquids in the MAG tank.

Figure 6:
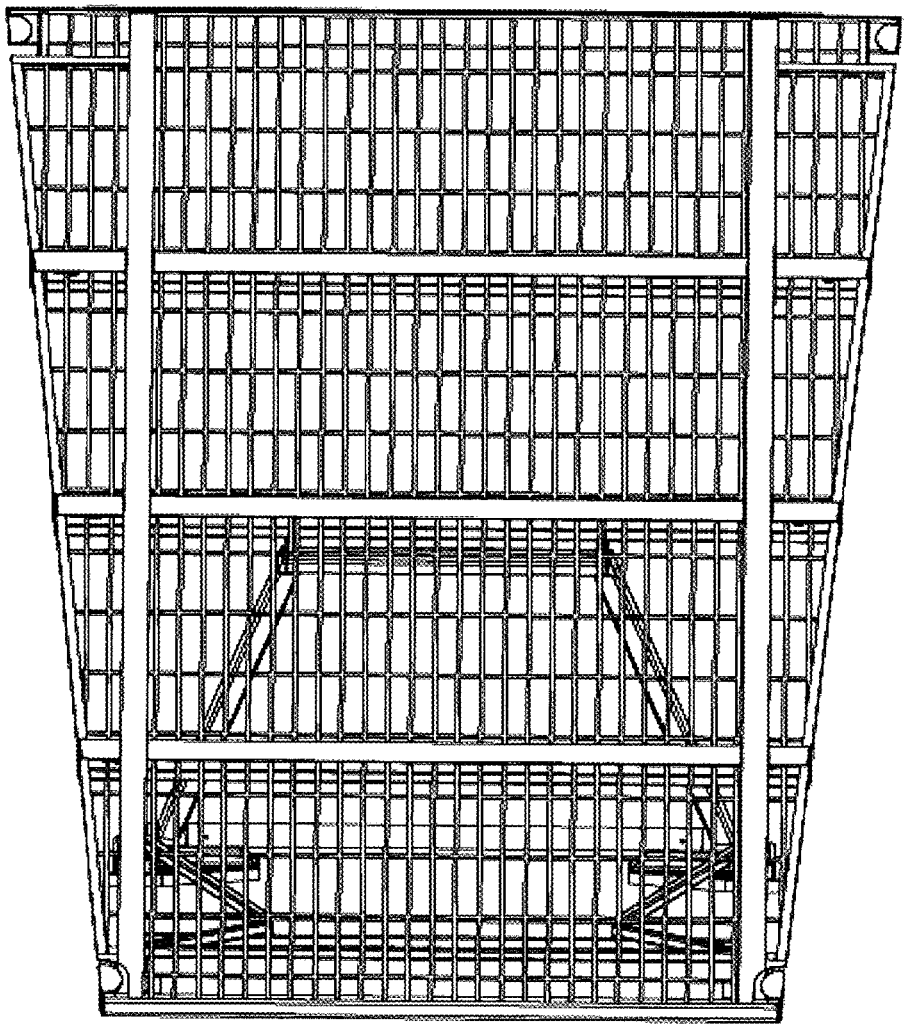
FIG. 6 is a front perspective view of a component panel of a MAG tank according to an embodiment of the disclosure.

FIG. 6 is a front perspective view of component panel 300 of a MAG tank according to an embodiment of the disclosure. Base frame 320 and brace frame 324 are partially visible through the holes in grid 350. As FIG. 6 clearly shows, grid 350 comprises a grill or mesh that forms a surface that supports a liner. The use of a mesh or grill makes grid 350 lighter in weight. However, in alternate embodiments, grid 350 may be replaced by a solid surface.

In addition, the disclosed MAG tank system is designed to be reusable and portable with a system being set up or taken down in a matter of hours. This is much faster than, for example, a bolted tank. The design of the MAG tank panel allows it to be fully self-supporting, not requiring a connection to an adjacent panel. This allows for less precise installation criteria (e.g., uneven ground) and creates a faster installation time. However, in some configurations, it may be desirable to connect adjacent panels to each other.

A geotextile fabric (or liner) may be unrolled and put in place on the tank walls and on the ground within the tank to provide containment of the fluid. When the tank is filled, the more fluid in the tank the greater the down-force placed on the geotextile membrane creating an even higher force to keep a panel from slipping.

Another feature to prevent slipping is the offset nature of the base assembly. It is designed to allow for minimum site disturbance, requiring a smaller ground area to be cleared. The inner portion of the tank does not have to be completely level. Although a 1% grade is preferred, it is not required. This allows for a small level trench to be the only site preparation required in some cases.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A modular tank comprising a plurality of panels positioned on a ground surface to form sides of a containment wall, wherein each panel comprises:

a side wall section having a trapezoidal shape; and a frame assembly reconfigurably attached to the side wall section and configured to support the side wall section such that:

in a first configuration, the side wall section is attached to the frame assembly such that a first base of the trapezoidal shape is disposed proximate a base of the containment wall and a second base of the trapezoid shape is supported in an elevated position to form part of an upper perimeter of the containment wall; and in a second configuration, the side wall section is attached to the frame assembly such that the second base of the trapezoidal shape is disposed proximate the base of the containment wall and the first base of the trapezoid shape is supported in an elevated position to form part of the upper perimeter of the containment wall, wherein the frame assembly comprises:

a beam frame to which the sidewall section is reconfigurably attached, wherein the beam frame comprises a horizontal crosspiece that removably attaches to a median region of the sidewall section approximately midway between the first base and the second base;

a base frame for supporting the frame assembly on the ground; and a brace frame coupled to the base frame and the beam frame for supporting the side wall section in an inclined position with respect to the ground, wherein the brace frame comprises:

a first leg coupled at one end to the horizontal crosspiece of the beam frame and at a second end to the base frame; and a second leg coupled at one end to the horizontal crosspiece of the beam frame and at a second end to the base frame.

2. The modular tank as set forth in claim 1, wherein the side wall section comprises a grid having holes therein.

3. The modular tank as set forth in claim 1, wherein the side wall section comprises a solid surface.

4. The modular tank as set forth in claim 1, wherein the side wall section is adapted to receive a liner operable to form a barrier for containing fluid in the modular tank.

5. A panel for use in a forming a containment wall of a modular tank positioned on a ground surface, wherein the panel comprises:

a side wall section having a trapezoidal shape; and a frame assembly reconfigurably attached to the side wall section and configured to support the side wall section such that:

in a first configuration, the side wall section is attached to the frame assembly such that a first base of the trapezoidal shape is disposed proximate a base of the containment wall and a second base of the trapezoid shape is supported in an elevated position to form part of an upper perimeter of the containment wall; and in a second configuration, the side wall section is attached to the frame assembly such that the second base of the trapezoidal shape is disposed proximate the base of the containment wall and the first base of the trapezoid shape is supported in an elevated position to form part of the upper perimeter of the containment wall, wherein the frame assembly comprises:

a beam frame to which the sidewall section is reconfigurably attached, wherein the beam frame comprises a horizontal crosspiece that removably attaches to a median region of the sidewall section approximately midway between the first base and the second base;

a base frame for supporting the frame assembly on the ground; and a brace frame coupled to the base frame and the beam frame for supporting the side wall section in an inclined position with respect to the ground, wherein the brace frame comprises:

a first leg coupled at one end to the horizontal crosspiece of the beam frame and at a second end to the base frame; and a second leg coupled at one end to the horizontal crosspiece of the beam frame and at a second end to the base frame.

6. The panel as set forth in claim 5, wherein the side wall section comprises a grid having holes therein.

7. The panel as set forth in claim 5, wherein the side wall section comprises a solid surface.

8. The panel as set forth in claim 5, wherein the side wall section is adapted to receive a liner operable to form a barrier for containing fluid in the modular tank.

* * * * *